US010635034B1

(12) United States Patent
Chen et al.

(10) Patent No.: US 10,635,034 B1
(45) Date of Patent: Apr. 28, 2020

(54) FIXATION DEVICE WITH ABNORMAL TEMPERATURE JUDGING MECHANISM AND LASER PRINTER USING SUCH FIXATION DEVICE

(71) Applicant: AVISION INC., Hsinchu (TW)

(72) Inventors: Hung Ming Chen, Miaoli County (TW); Hui Hsien Chen, Nantou County (TW); Jung Hsiang Yang, Changhua County (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/410,039

(22) Filed: May 13, 2019

(30) Foreign Application Priority Data

Mar. 27, 2019 (TW) ..... 108110641 A

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC ..... G03G 15/2039; G03G 15/2042; G03G 15/205
USPC ..... 399/33, 69, 70
See application file for complete search history.

(56) References Cited

U.S. PATENT DOCUMENTS 7,212,754 B2 * 5/2007 Fujiwara ..... G03G 15/2046 399/33
8,265,495 B2 * 9/2012 Sato ..... G03G 15/2039 399/33
2008/0187371 A1 8/2008 Tsai et al.

FOREIGN PATENT DOCUMENTS

TW 200834269 A 8/2008
TW 201019063 A 5/2010

OTHER PUBLICATIONS

Taiwanese Office Action which corresponds to Application No. 108110641; dated Oct. 31, 2019.
Taiwanese Office Action in application No. 10821037380 dated Oct. 31, 2019; pp. 1-9.

* cited by examiner

*Primary Examiner* — William J Royer
(74) *Attorney, Agent, or Firm* — Muncy, Geissler, Olds & Lowe, PC

(57) ABSTRACT

A fixation device performing a fixation process on a medium in conjunction with a pressure roller includes: a fuser heating to a predetermined temperature to perform the fixation process; a temperature sensor senses a temperature of the fuser as time elapses; a controller electrically connected to the fuser and the temperature sensor; and a database connected to the controller and storing heating time data; wherein the controller obtains a heating time period, during which a temperature of the fuser rises from a non-environment temperature to the predetermined temperature, through the temperature sensor, and judges whether the heating time period falls within a qualified range specified by the heating time data. If the heating time period does not fall within the qualified range, then the controller provides an abnormal message, so that the problem of the fixation device can be solved.

10 Claims, 2 Drawing Sheets

FIXATION DEVICE WITH ABNORMAL TEMPERATURE JUDGING MECHANISM AND LASER PRINTER USING SUCH FIXATION DEVICE

CROSS-REFERENCE TO RELATED APPLICATIONS

This application claims priority of No. 108110641 filed in Taiwan R.O.C. on Mar. 27, 2019 under 35 USC 119, the entire content of which is hereby incorporated by reference.

BACKGROUND OF THE INVENTION

Field of the Invention

This disclosure relates to a fixation device and a laser printer using such fixation device, and more particularly to a fixation device with an abnormal temperature judging mechanism and a laser printer using such fixation device.

Description of the Related Art

Generally speaking, a laser printer currently available on the market needs to heat a fuser working in conjunction with a temperature sensing element for sensing a real-time temperature of the fuser. When the temperature has not reached a predetermined temperature (e.g., a preheating temperature, a printing temperature or the like, wherein the predetermined temperature is 100° C. or 180° C., for example), the fuser is continuously heated until the temperature reaches the predetermined temperature. After the temperature has reached the predetermined temperature, heating is stopped. When the heating is being conducted, the time for the fuser to reach the predetermined temperature is counted. If the counted time exceeds a predetermined time (e.g., ten seconds are needed to reach the predetermined temperature), the machine judges the fuser as encountering an error, and notifies the user to re-boot this machine. After the user has rebooted the machine, because the time from the previously booting is very short, the time for the fuser to reach the predetermined temperature cannot exceed the predetermined time (if the time exceeds the predetermined time, the machine can be re-booted many times). So, the printer can be continuously used. Although the printer still can be used, there is the problem that the heater of the printer may age, or that the temperature sensor has the offset, thereby causing the poor printing quality. Alternatively, the assembler may incorrectly connect the heater having the rated voltage of 110 volts to the printer having the rated voltage of 220 volts, so that the temperature of the heater rises too fast and the heater burns out. Alternatively, the assembler may incorrectly connect the heater with the rated voltage of 220 volts to the printer with the rated voltage of 110 volts, so the heater cannot reach the predetermined temperature within the predetermined time at the beginning. However, after the printer has been repeatedly booted up several times, the heater can reach the predetermined temperature within the predetermined time. This is also a problem which needs to be solved.

The current method is to count the time for the temperature of the fuser to rise from 25° C. to 180° C. That is, it is judged whether the temperature can reach 180° C. at the 20th second after booting up. Thus, the initial temperature is regarded as 25° C. for calculation. Therefore, when the initial temperature is 100° C., the time needed for the fuser to reach the temperature of 180° C. may not be so long, but the temperature of the problematic heater still can rise to 180° C. within 20 seconds. At this time, however, the heater has been in the state indicating that the heater cannot be normally used, and this may burn out other elements of the printer.

BRIEF SUMMARY OF THE INVENTION

Therefore, an objective of this disclosure is to provide a fixation device with an abnormal temperature judging mechanism and a laser printer using such fixation device, wherein the abnormal temperature judging mechanism is utilized to solve the problem induced by the failure or aging of the heater, or that the heater is incorrectly installed.

To achieve the above-identified object, this disclosure provides a fixation device. The fixation device performs a fixation process on a medium in conjunction with a pressure roller. The fixation device includes a fuser, a temperature sensor, a controller and a database. The fuser heats to a predetermined temperature to perform the fixation process. The temperature sensor senses a temperature of the fuser as time elapses. The controller is electrically connected to the fuser and the temperature sensor. The database is connected to the controller and stores heating time data. The controller obtains a heating time period, during which the temperature of the fuser rises from a non-environment temperature to the predetermined temperature, through the temperature sensor, and judges whether the heating time period falls within a qualified range specified by the heating time data. If the heating time period does not fall within the qualified range, then the controller provides an abnormal message.

This disclosure further provides a laser printer, which includes the above-mentioned fixation device and pressure roller.

With the embodiment of this disclosure, it is possible to obtain different ranges of heating time periods according to different initial temperatures of the fuser of the printer sensed before heating through the look-up table or the slope calculation. It is judged whether the actual heating time period falls within the obtained range of the heating time period by way of calculation. If the actual heating time period is too short, then the heating of the fuser must be stopped, the printing operation is not performed to prevent the fuser or even the machine from burning out, and the user or maintenance man is notified to conduct the maintenance. If the actual heating time period is too long, then the user must be notified to re-boot the machine for test. After the re-booting, a different mechanism of judging the heating time period may also be provided. If the actual heating time period is still too long, then the user is notified to send the machine back to the original factory for analysis, and the original factory can analyze whether the heater in the fuser of the machine ages or whether the temperature sensing element is not installed to the correct position according to this condition.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

In the embodiment of this disclosure, a method of judging a heating time period of a fuser is modified. It is judged whether different time periods for the temperature of the fuser to rise from different initial temperatures before heating to the predetermined temperature can satisfy a qualified range specified by the heating time data (e.g., the data listed in Table 1, the range of the heating slope or the like), so that the laser printer can determine whether the heater of the fuser encounters a problem more accurately. If the problem is present, then an error message may be sent to an assembler for reference, or an error message may be sent to a user to carry the laser printer to a maintenance center to prevent the heating temperature from rising too slow, to prevent the printing quality from getting deteriorated, to prevent the heating temperature from rising too fast, to prevent the fuser from burning out, or even to prevent the printer from burning out and sparking.

The judging mechanism in the following embodiment is applicable to the machine assembling occasion and the practical application occasion of the end user.

TABLE 1

| Initial Temperature (° C.) Of The User Upon Booting Up | Predetermined Temperature (° C.) | Range of the heating time period (seconds) |
|---|---|---|
| 25 | 180 | 18~20 |
| 50 | 180 | 14~16 |
| 75 | 180 | 10~12 |
| 100 | 180 | 7~9 |
| 125 | 180 | 4~6 |
| 150 | 180 | 2~4 |

Figure 1:
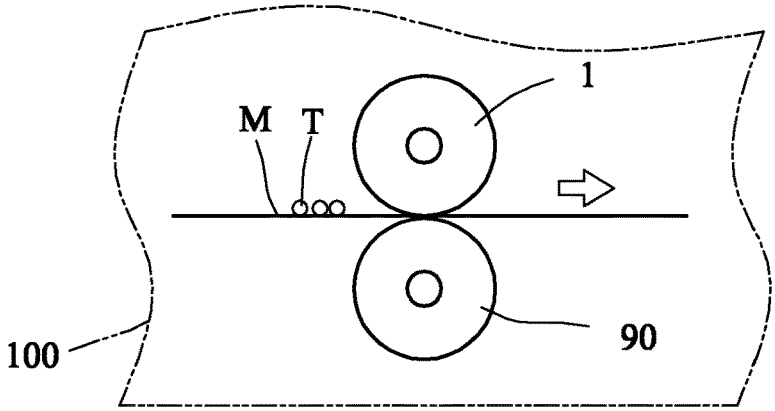
FIG. 1 is a schematic view showing a fixation device and a pressure roller according to a preferred embodiment of this disclosure.
Figure 2:
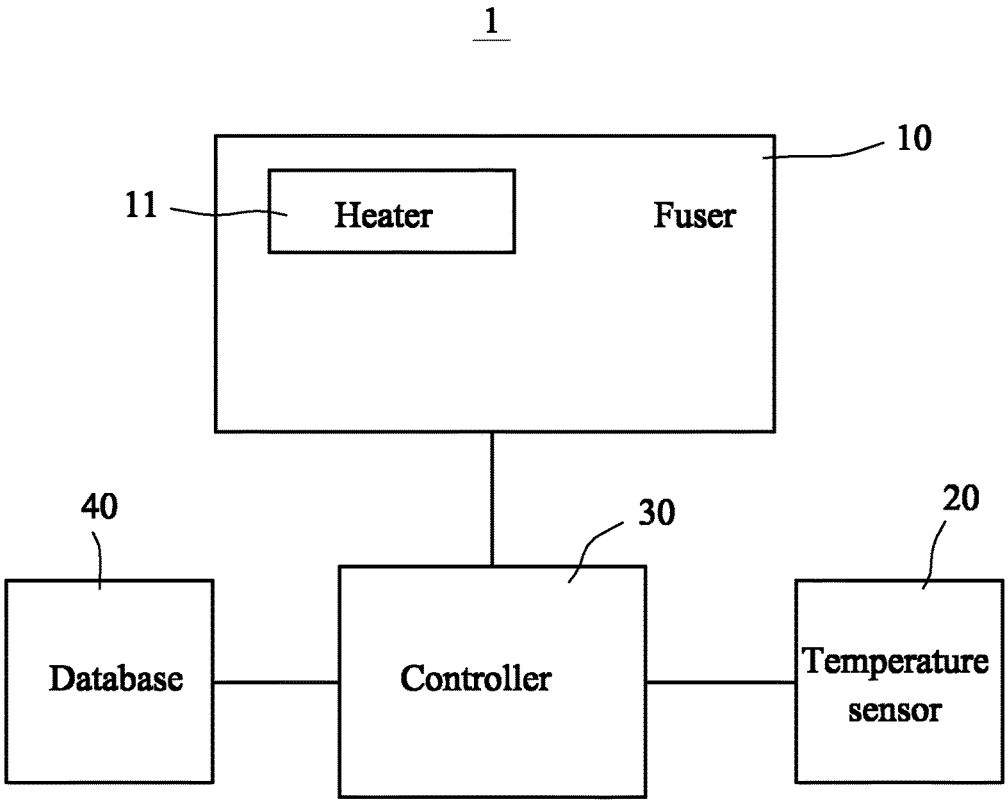
FIG. 2 is a block diagram showing the fixation device according to the preferred embodiment of this disclosure.

FIG. 1 is a schematic view showing a fixation device and a pressure roller according to a preferred embodiment of this disclosure. FIG. 2 is a block diagram showing the fixation device according to the preferred embodiment of this disclosure. Referring to FIGS. 1 and 2, this embodiment provides a fixation device 1 for performing a fixation process on a medium M in conjunction with a pressure roller 90 (e.g., for fixing toner (e.g., dry toner) T onto the medium M). The fixation device 1 includes a fuser 10, a temperature sensor 20, a controller 30 and a database 40. This embodiment also provides a laser printer 100, which includes the above-mentioned fixation device 1 and pressure roller 90.

The fuser 10 heats to a predetermined temperature to perform the fixation process. In this embodiment, the fuser 10 is present in a form of a heater roller, but this disclosure is not limited thereto. The predetermined temperature is a working temperature of the fuser 10 and ranges between 160 degrees Celsius and 200 degrees Celsius, such as 180 degrees Celsius. In other embodiments, the predetermined temperature is a preheating temperature of the fuser 10 and ranges between 90 degrees Celsius and 120 degrees Celsius, such as 100 degrees Celsius. In this embodiment, the fuser 10 is a fixation roller, which includes a heater 11. The heater 11 may be a halogen lamp or a ceramic heater, and receives an alternating current to operate.

The temperature sensor 20 senses a temperature of the fuser 10 as time elapses. For example, the temperature is sensed every 0.1 or 0.2 seconds. The controller 30 is electrically connected to the fuser 10 and the temperature sensor 20. The database 40 is connected to the controller 30, and stores heating time data.

The controller 30 obtains a heating time period, during which a temperature of the fuser 10 rises from a non-environment temperature to the predetermined temperature, through the temperature sensor 20. In this embodiment, the non-environment temperature ranges between 140 degrees Celsius and the predetermined temperature. In addition, the controller 30 further judges whether the heating time period falls within a qualified range specified by the heating time data. In one example, the heating time data is present in a form of a look-up table, for example, wherein the look-up table in Table 1 records multiple sets of relationships between the non-environment temperature and the qualified range. In Table 1, the qualified range of the heating time period for the fuser to rise from the initial temperature of 25° C. to the temperature of 180° C. ranges between 18 and 20 seconds, and this relates to the normal temperature judging mechanism. Other mechanism relating to the ranges of the heating time periods for the fuser to rise from the initial temperatures from 50 to 150° C. pertain to the abnormal temperature judging mechanism. It is worth noting that there may be more initial temperatures of the Table 1, which will not be listed in detail. Alternatively, the initial temperature which does not correspond to the range of the heating time period may be determined by way of interpolation.

If the heating time period does not fall within the qualified range, then the controller 30 provides an abnormal message, which may be displayed on a panel or provided as warning sound. More particularly, if the heating time period does not falls within the qualified range, then the controller 30 further stops heating of the fuser 10 to prevent the fuser 10 from burning out.

In still another example, Table 1 may have another set of predetermined temperatures and ranges of the heating time periods. For example, the heating time period for the temperature to rise from 50° C. to 100° C. (the preheating temperature upon booting up but not for printing) ranges between 3 and 5 seconds, so that the controller can judge whether the low-temperature heating behavior and the high-temperature heating behavior of the heater become abnormal. For example, some problematic heaters can reach 180° C. within the qualified range of time, but cannot reach 100° C. within another qualified range of time; or vice versa. Therefore, in this example, the controller 30 further obtains a second heating time period for the fuser 10 to rise from the non-environment temperature to a second predetermined temperature (the second predetermined temperature ranges between the non-environment temperature and the predetermined temperature) through the temperature sensor 20, and judges whether the second heating time period falls within a second qualified range specified by the heating time data. If the second heating time period does not fall within the second qualified range, then the controller 30 provides a second abnormal message.

In order to obtain the initial temperature of the fuser 10, the controller 30 firstly receives a boot up temperature of the fuser 10 sensed by the temperature sensor 20 upon booting up, and then controls the fuser 10 to perform heating to obtain the heating time period required to reach the predetermined temperature.

Figure 3:
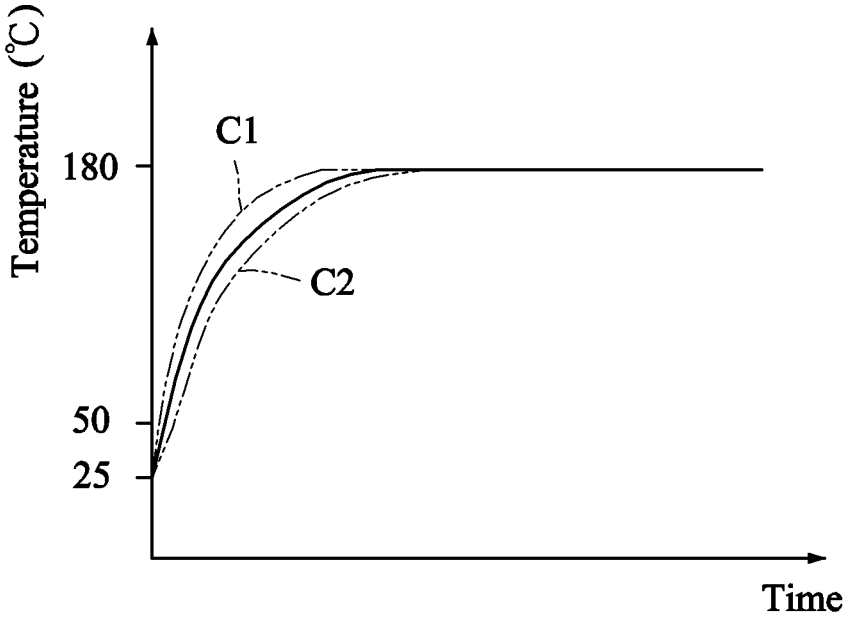
FIG. 3 is a graph showing the relationship of time versus temperature of the fixation device.

FIG. 3 is a graph showing the relationship of time versus temperature of the fixation device. As shown in FIG. 3, the heating time data is present in a form of a range of a heating rate. That is, the database 40 may also store the data of the range of the heating rate. Any heating rate falling in the range between the upper curve C1 and the lower curve C2 pertains to that of the qualified heater. The judging reference may refer to the time for the fuser to reach 180 t, and may also refer to the time for the fuser to reach 100° C. or the times for the fuser to reach other temperatures serving as multiple references.

With the embodiment of this disclosure, it is possible to obtain different ranges of heating time periods according to different initial temperatures of the fuser of the printer sensed before heating through the look-up table or the slope calculation. It is judged whether the actual heating time period falls within the obtained range of the heating time period by way of calculation. If the actual heating time period is too short, then the heating of the fuser must be stopped, the printing operation is not performed to prevent the fuser or even the machine from burning out, and the user or maintenance man is notified to conduct the maintenance. If the actual heating time period is too long, then the user must be notified to re-boot the machine for test. After the re-booting, a different mechanism of judging the heating time period may also be provided. If the actual heating time period is still too long, then the user is notified to send the machine back to the original factory for analysis, and the original factory can analyze whether the heater in the fuser of the machine ages or whether the temperature sensing element is not installed to the correct position according to this condition.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A fixation device performing a fixation process on a medium in conjunction with a pressure roller, the fixation device comprising:

a fuser heating to a predetermined temperature to perform the fixation process;

a temperature sensor sensing a temperature of the fuser as time elapses;

a controller electrically connected to the fuser and the temperature sensor; and a database, which is connected to the controller and stores heating time data;

wherein the controller obtains a first heating time period, during which the temperature of the fuser rises from a non-environment temperature to the predetermined temperature, through the temperature sensor, and judges whether the first heating time period falls within a range specified by the heating time data, wherein if the first heating time period does not fall within the range, then the controller provides an abnormal message.

2. The fixation device according to claim 1, wherein the predetermined temperature ranges between 160 degrees Celsius and 200 degrees Celsius.

3. The fixation device according to claim 1, wherein the non-environment temperature ranges between 140 degrees Celsius and the predetermined temperature.

4. The fixation device according to claim 1, wherein if the first heating time period does not fall within the range, then the controller further disables the fuser from heating.

5. The fixation device according to claim 1, wherein upon booting up, the controller firstly receives a boot up temperature of the fuser sensed by the temperature sensor, and then controls the fuser to perform heating to obtain the first heating time period required for the fuser to reach the predetermined temperature.

6. The fixation device according to claim 1, wherein the heating time data is present in a form of a look-up table, which records multiple sets of relationships between the non-environment temperature and the range.

7. The fixation device according to claim 1, wherein the heating time data is present in a form of a range of a heating rate.

8. The fixation device according to claim 1, wherein the fuser comprises a heater, which is a halogen lamp or a ceramic heater, and receives an alternating current to operate.

9. The fixation device according to claim 1, wherein the controller further obtains a second heating time period, during which the temperature of the fuser rises from the non-environment temperature to a second predetermined temperature, through the temperature sensor, and judges whether the second heating time period falls within a second range specified by the heating time data, wherein if the second heating time period does not fall within the second range, then the controller provides a second abnormal message, wherein the second predetermined temperature ranges between the non-environment temperature and the predetermined temperature.

10. A laser printer, comprising the fixation device and the pressure roller according to claim 1.

* * * * *